United States Patent [19]

Murrell et al.

[11] 4,424,114

[45] Jan. 3, 1984

[54] SEPARATING BASIC ASPHALTENES USING TRANSITION METAL OXIDE ACID CATALYSTS

[75] Inventors: Lawrence L. Murrell, South Plainfield; Dane C. Grenoble, Plainfield; Robert B. Long, Atlantic Highlands, all of N.J.

[73] Assignee: Exxon Research and Engineering Co., Florham Park, N.J.

[21] Appl. No.: 305,268

[22] Filed: Sep. 24, 1981

[51] Int. Cl.[3] ..... C10G 11/04; C10G 25/00; C10G 25/12

[52] U.S. Cl. ..... 208/86; 208/120; 208/122; 208/123; 208/309

[58] Field of Search ..... 208/86, 91, 122, 123, 208/120, 309, 254 R, 251 R, 310 R, 310 Z

[56] References Cited

U.S. PATENT DOCUMENTS

| | | | |
|---|---|---|---|
| 2,956,004 | 10/1960 | Conn et al. | 208/91 |
| 3,530,066 | 9/1970 | Kunata et al. | 208/309 |
| 4,069,268 | 1/1978 | Siskin et al. | 208/134 |
| 4,090,948 | 5/1978 | Schwarzenbek | 208/74 |
| 4,090,951 | 5/1978 | Smith | 208/91 |
| 4,123,379 | 10/1978 | Gates et al. | 252/184 |
| 4,125,457 | 11/1978 | Brennan et al. | 208/254 R |
| 4,137,154 | 1/1979 | Audeh | 208/254 R |
| 4,233,139 | 11/1980 | Murrell et al. | 208/112 |
| 4,244,811 | 1/1981 | Grenoble et al. | 208/122 |

OTHER PUBLICATIONS

Yen; *Shale Oil, Tar Sands, and Related Fuel Sources;* Am. Chem. Soc. (1976), pp. 30–33.

*Primary Examiner*—Patrick Garvin
*Assistant Examiner*—O. Chaudhuri
*Attorney, Agent, or Firm*—Edward M. Corcoran

[57] ABSTRACT

Basic asphaltenes are selectively removed from asphaltene-containing hydrocarbon feeds by contacting the feed with a transition metal oxide solid acid catalyst which selectively adsorbs the basic asphaltenes. The catalyst will comprise a catalytic metal component selected from the group consisting essentially of oxides of (a) tungsten, niobium, and mixtures thereof and (b) mixtures of (a) with tantalum, hafnium, chromium, titanium, zirconium and mixtures thereof, supported on an inorganic refractory oxide support such as alumina. Asphalt-laden catalyst is separated from the feed, the asphaltenes adsorbed thereon are cracked off in the presence of steam and the catalyst is regenerated and recycled back to the adsorption zone.

23 Claims, 1 Drawing Figure

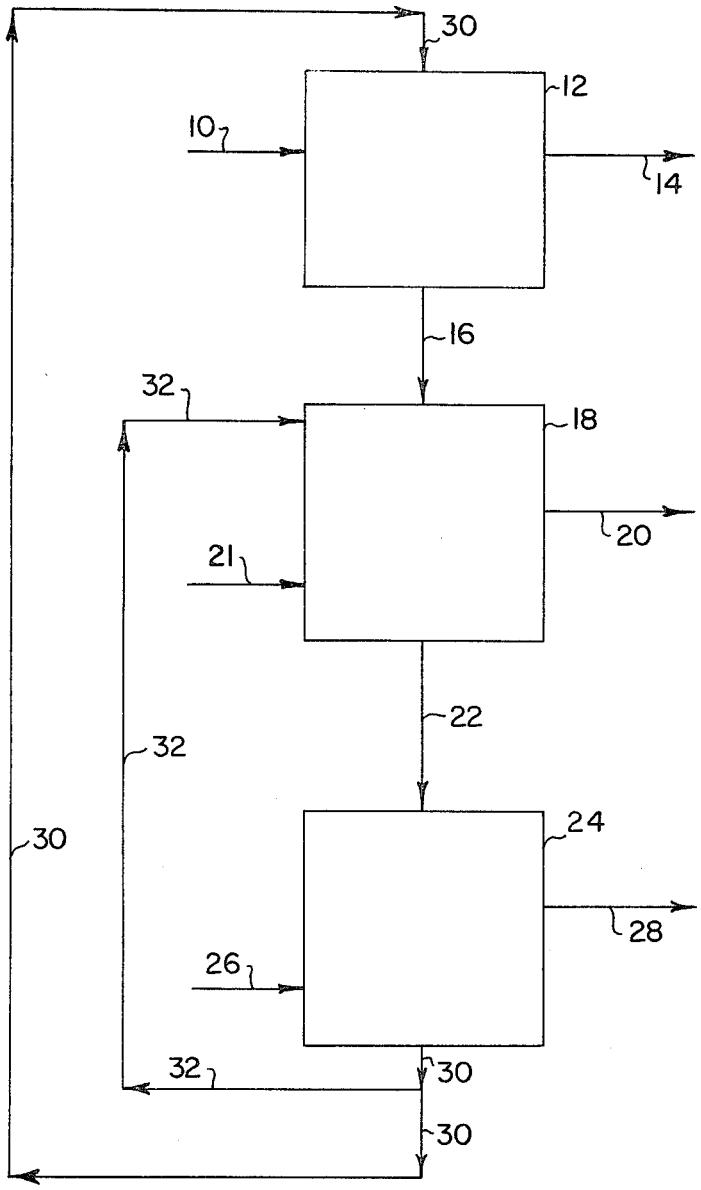
30
12
10
14
16
32
18
20
21
22
32
24
30
28
26
32
30
30

SEPARATING BASIC ASPHALTENES USING TRANSITION METAL OXIDE ACID CATALYSTS

BACKGROUND OF THE INVENTION

1. Field of the Invention

This invention relates to selectively adsorbing basic asphaltenes on transition metal oxide solid acid catalysts. More particularly, this invention relates to a process for the selective removal of basic asphaltenes from an asphaltene-containing hydrocarbon feed by contacting said feed with a transition metal oxide solid acid catalyst to produce a feed of reduced basic asphaltene content and a catalyst containing basic asphaltenes.

2. Background of the Disclosure

Conventional hydrodesulfurization, hydrodenitrogenation, hydrocracking, cat cracking, reforming and other hydroconversion processes cannot be used on feeds containing appreciable amounts of asphaltene materials due to coking and deactivation of the catalyst by the asphaltenes. Basic asphaltenes are the most troublesome in this regard.

It is known in the art that asphaltenes can be separated into basic and non-basic fractions using mineral acid separation techniques. Basic asphaltenes have been precipitated from various crude oils by potentiometric titration with perchloric acid and there are earlier reports of the use of potentiometric titration to determine basic nitrogen (Nicksic, S. W. and Jeffries-Harris, M. J., Inst. Petrol., 54 (532), 107–114 (1968)). H. Sternberg developed a technique for separating basic and non-basic asphaltenes from coal liquids by first dissolving the asphaltenes in toluene, followed by saturating the solution with anhydrous HCl which precipitates a basic asphaltene-HCl complex from the solution. The precipitate is filtered and the basic asphaltenes are recovered by treating the asphaltene-HCl complex with caustic solution (Sternberg, H. W., Raymond, R., and Schweighardt, F. K., Science, 188, 49 (1975)). In this technique, the non-basic asphaltenes remain in the original toluene solution and are recovered from the filtrate by evaporating off the toluene.

Increasing world petroleum consumption and declining availability of high quality crude oils has forced both producers and refiners of petroleum alike to turn more and more to low quality, heavy crudes having relatively high residuum and concomitant high asphaltene contents. Further, synthetic feeds derived from Alberta Tar Sands, Cold Lake Crude, coal liquid, Venezuelan tar sands and the like also contain appreciable amounts of asphaltenes. Therefore, there is a need for processes which can readily remove at least a portion of the asphaltenes, and particularly the basic asphaltenes, from feeds containing same to permit further processing of the asphaltene-reduced feed into useful products such as chemicals, solvents, fuels and lubricating oils. It would be particularly beneficial if such processes could also make liquid products out of the separated basic asphaltenes.

U.S. Pat. No. 3,691,063 discloses employing solid acid catalysts, such as silica-alumina, in a guard case operated at from 600°–1,000° F. to remove metals and asphaltenes from heavy feeds prior to hydrocracking same. Under these temperature conditions some of the adsorbed asphaltenes are cracked in-situ in the guard case. This in-situ cracking tends to coke the catalyst therein, thereby reducing both its adsorption capacity and selectivity for the basic asphaltenes. U.S. Pat. Nos. 2,944,002 and 2,432,644 disclose the use of solid acid catalysts in guard cases for removing metal and nitrogencontaining catalyst contaminants from feeds being fed to cat crackers. However, none of the processes disclosed in these two patents permits an asphalt-containing feed to be fed to the guard case. In fact, U.S. Pat. No. 2,944,002 repeatedly teaches that the feed going to the guard case must first be deasphalted if it is an asphaltene-containing feed.

SUMMARY OF THE INVENTION

It has now been discovered that the basic asphaltenes present in asphalt-containing hydrocarbon feeds or oils are selectively adsorbed onto solid acid catalysts comprising one or more supported transition metal oxides, hereinafter referred to as TMO catalysts. Thus, the present invention relates to a process for producing an oil of reduced basic asphaltene content by contacting the feed, in an adsorption zone, with a TMO catalyst. Contacting the feed with the catalyst at a temperature below about 575° F. avoids cracking the asphaltenes in the adsorption zone, to produce an asphaltene-reduced feed and a basic asphaltene-containing catalyst which must be separated from the feed. The basic asphaltenes are cracked off the catalyst, preferably in the presence of steam to reduce coke formation, after which the catalyst is regenerated and recycled back to the adsorption zone. Optionally, contacting at temperatures higher than about 575° F. will result in in-situ cracking of the asphaltenes in the adsorption zone. In this case, a portion of the catalyst may be continuously withdrawn from the adsorption zone, with the subsequent cracking, regeneration and recycling back to the adsorption zone. Alternatively, one can employ alternating adsorption zones.

The transition metal oxide solid acid catalysts or TMO catalysts useful in the process of this invention will comprise oxides of one or more metals selected from the group consisting essentially of (a) tungsten, niobium and mixtures thereof and (b) mixtures of (a) with tantalum, hafnium, chromium, titanium and zirconium and mixture thereof, supported on an inorganic refractory oxide support, preferably alumina. In a preferred embodiment of this invention the catalyst is calcined at a temperature of at least about 150° C. prior to being contacted with the asphalt-containing feed. This is done in order to remove adsorbed water from its surface which would reduce its adsorptive capacity for basic asphaltenes.

By solid acid is meant a solid material which exhibits acidity when titrated with n-butyl amine according to the Benesi method. As those skilled in the art know the Benesi method is one of the most widely used and accepted methods for determining the nature and amount of acidity or acid sites on cracking catalysts (H. A. Benesi, J. Amer. Chem. Soc., 89, p. 5490 (1956)).

BRIEF DESCRIPTION OF THE DRAWING

The attached FIGURE is a flow diagram of a preferred embodiment of a process of this invention, including regeneration and recycling of the catalyst back to the adsorption zone.

DETAILED DESCRIPTION

The transition metal oxide solid acid catalysts useful in the process of this invention and the methods useful in preparing them are known in the art and may be found, for instance, in U.S. Pat. Nos. 4,233,139; 4,244,811; and 4,269,737; the disclosures of which are incorporated herein by reference. These catalysts are unexpectedly coke tolerant and can function as acid cracking catalysts in the presence of much larger quantities of coke than conventional silica-alumina cracking catalysts. Thus, as hereinbefore stated, these catalysts comprise a catalytic transition metal oxide component supported on a refractory metal oxide support. The catalytic metal oxide is selected from the group consisting essentially of the oxides of (a) tungsten, niobium and mixtures thereof and (b) mixtures of (a) with tantalum, hafnium, chromium, titanium, zirconium, and mixtures thereof. These transition metal oxides will be supported on refractory metal oxide supports including, but not limited to, alumina, zirconia, boria, thoria, magnesia, titania, chromia, silica-alumina, kieselguhr and mixtures thereof, as well as compounds of two or more support materials (such as zirconium titanate) alone or mixed with other support materials. In a preferred embodiment the support will comprise alumina and most preferably $\gamma$-alumina. If the support comprises a mixture of silica and alumina, it is preferred that the silica content thereof be less than 50 wt. % of the alumina content. The refractory oxide support should have a high surface area in the region of from about 20 to 500 $m^2/g$, preferably 40 to 200 $m^2/g$, and most preferably over 100 $m^2/g$ prior to the deposition of the transition metal oxide salt precursor used in forming the catalyst. These surface areas are as measured by the Brunauer-Emmett-Teller (BET) method.

These catalysts may also advantageously contain minor amounts of various promoter materials selected from one or more oxides of Group IIA. Particularly preferred are oxides of barium, calcium, strontium and mixtures thereof. These promoter materials, in the form of precursor salts, can be incorporated into the carrier simultaneously with the metal precursor salt, or sequentially (the order of addition being merely a matter of choice), or may be coprecipitated with the metal precursor salts and carrier precursor salts. Alternatively, they may be added subsequent to the formation of the catalyst composite. If used at all, these promoters will be present in an amount ranging from about 0.01 to 4.0 wt. % promoter based on total catalyst composition wherein the amount of promoter metal oxide ranges from 0.1% to 4%, preferably, 0.1% to 0.5%.

In co-pending application Ser. No. 305,267 filed simultaneously herewith, solid acids, such as well-known acid cracking catalysts including silica/alumina are employed to selectively adsorb basic asphaltenes from an asphaltene-containing feed, at a temperature below about 575° F. in order to avoid cracking of the asphaltenes in the adsorption zone. However, ordinary solid acids such as the well-known silica/alumina acid cracking catalysts are not resistant to steaming. That is, steaming destroys the acid sites resulting in destruction of both the adsorptive and cracking ability of the catalyst, whereas the TMO catalysts useful in the process of this invention are resistant to high temperature (i.e., $\geqq$600° C.) steaming. In fact, in some instances, it may be preferred to subject these TMO catalysts to high temperature steaming prior to use.

Asphalt-containing hydrocarbon feeds or oils useful in the process of this invention include any naturally occurring, asphalt-containing mineral oils and fractions thereof such as whole and topped crude oils, vacuum and atmospheric residua, etc. as well as asphalt-containing synthetic feeds or oils derived from the liquefaction of coal, from tar sands, Cold Lake crude, etc. The process of this invention is sensitive to the presence of water. Therefore, it is preferred that the feed not contain too much water, because the solid acid will preferentially adsorb the water at the expense of adsorbing the basic asphaltenes. Hence, the water content of the feed, if any, should be appreciably lower than the basic asphaltene content of the feed. Therefore, it is preferred that the water content of the feed be less than about 1 wt. % unless one wishes to control the basic asphaltene adsorption onto the catalyst via control of the water content of the feed in the adsorption zone.

In the process of this invention, the temperature, pressure and residence time of the asphaltcontaining feed in the adsorption zone are not particularly critical as long as the temperature is below about 575° F. if one desires to avoid cracking in the adsorption zone and as long as the desired degree of removal of basic asphaltenes from the feed is achieved. In general, this means that the maximum temperature employed in the adsorption zone will be no greater than about 575° F., preferably no greater than about 550° F., and still more preferably no greater than about 500° F. It has been found that the solid acid catalyst can adsorb up to about 20% of its weight of basic asphaltenes and, if desired, substantially all of the basic asphaltenes may be removed from the feed in the adsorption zone. Alternatively, if it is desired to have in-situ cracking of the adsorbed asphaltenes occur in the adsorption zone, then the adsorption zone will operate at a temperature above 575° F., preferably above about 600° F., and still more preferably above about 650° F. The minimum pressure is that required to force the asphaltene-containing feed through the adsorption zone.

Thus, the conditions of pressure, temperature and space velocity may be adjusted to suit ones needs. In general, however, the pressure in the adsorption zone will be at least about 25 psig, the temperature will range from about 200°–500° F. (for the case of adsorption only) or above about 600° F. (if in-situ cracking is desired), with a residence time of the feed in the adsorption zone of from about 2–600 minutes and a liquid hourly space velocity of from about 0.1 to 30 V/V/hr. The TMO catalyst may be in the form of a fixed or fluid bed or one may use a slurry-plus-settler technique wherein the TMO catalyst and asphalt-containing feed pass cocurrently through the adsorption zone and are then passed to a settling zone to separate the solid acid containing the adsorbed basic asphaltenes from the basic asphaltene-reduced feed. Alternatively, the slurry may be sent to hydroclones or filtration means to separate the basic asphaltene-laden TMO catalyst from the feed. In any event, the TMO catalyst containing the adsorbed basic asphaltenes must be periodically separated from the feed. The basic asphaltenes may then be cracked off to produce liquid and coke, with the coke-laden catalyst regenerated, calcined and then recycled back to the adsorption zone. The asphaltenes may be cracked off or burned off in the presence of steam to reduce coke formation. However, it should be noted that cracking the asphaltenes off the catalyst as opposed to burning will result in recovering more liquid product from the asphaltenes.

The catalyst will typically be regenerated in a regenerator at a pressure below about 150 psig at a temperature of from about 1400°–2800° F. (760°–1535° C.), preferably at a temperature greater than about 1500° F., more preferably at a temperature in a range of about 1600° to 1900° F. and most preferably at a temperature in the range of about 1700° to 1800° F. The coked catalyst may be introduced into the regenerator in the presence of steam and an oxygen containing gas, such as air, to produce a low BTU value fuel gas containing $H_2$ and CO.

DESCRIPTION OF A PREFERRED EMBODIMENT

Referring to the FIGURE, an asphaltene-containing feed, such as a crude oil derived from the Cold Lake region of Canada, is heated by means not shown to a temperature of about 300° F. and passed via line 10 to adsorption zone 12 at a pressure of about 50 psig. Adsorption zone 12 operates at a temperature of about 300° F., a pressure of about 50 psig and contains a catalyst comprising 10 wt. % $WO_3$ on alumina. The residence time of the oil in adsorption zone 12 will be less than about 1 hour and the ratio of oil to catalyst will generally range from about 1 to 10 volumes of oil to one volume of catalyst, the combination being sufficient for at least about 90 wt. % of the basic asphaltenes present in the feed to be adsorbed onto the solid acid catalyst to produce an oil of reduced basic asphaltene content. The basic asphaltene-reduced oil or feed is removed from adsorption zone 12 via line 14 and sent to further upgrading processes such as hydrocracking, catalytic cracking, hydrorefining, etc. Catalyst particles laden with adsorbed basic asphaltenes are continuously withdrawn from zone 12 via line 16 and passed to cracking zone 18. Cracking zone 18 operates at a temperature above about 750° F. and at a pressure ranging from atmospheric to about 50 psig. In cracking zone 18, the basic asphaltenes are catalytically cracked off the catalyst particles in the presence of steam entering via line 21, to produce liquid and gaseous products which are removed from zone 18 via line 20. This cracking also produces a coked catalyst. Heat is supplied to zone 18 via hot, regenerated catalyst particles entering zone 18 via line 32. Coked catalyst particles are removed from cracking zone 18, via line 22 and passed to catalyst regeneration zone 24 which operates at a temperature of from about 1600°–1900° F. Air and steam are passed into regeneration zone 24, via line 26 to burn the coke off the catalyst and simultaneously produce a low BTU value fuel gas which is removed from regeneration zone 24 via line 28. A portion of the hot, regenerated catalyst is removed from zone 24 via line 30, cooled by means not shown and recycled back to adsorption zone 12. The rest of the hot catalyst is recycled back to zone 18 via line 32.

The invention will be further understood by reference to the examples below.

EXAMPLES

Examples 1–5 are presented to establish the fact that solid acids selectively adsorb basic asphaltenes from mixtures of basic and non-basic asphaltenes and other materials; it is being established and known in the art that the TMO catalysts used in the processes of this invention are solid acid materials (c.f. U.S. Pat. Nos. 4,233,139; 4,244,811; and 4,269,737). Example 6 establishes the moisture sensitivity of solid acids to adsorptive selectivity for basic asphaltenes.

EXAMPLE 1

This example establishes the fact that solid acids selectively adsorb basic asphaltenes from a mixture of basic and non-basic asphaltenes. The asphaltenes used in this experiment were precipitated from a 1050° F.+ vacuum residuum obtained from a Canadian Cold Lake crude and also from a Tia Juana crude using standard deasphalting procedures employing n-heptane to effect the precipitation. A solution of 3 wt. % of these asphaltenes in toluene was made and a basic/non-basic split made using HCl precipitation according to the Sternberg technique previously discussed. The results are shown in Table 1. Next, samples of commercial silica/alumina cracking catalysts obtained from Grace Chemical Company, containing 13% $Al_2O_3$(DA-1) and 25% $Al_2O_3$(Hi-Al) were calcined at 500° C. for 16 hours and stored in a nitrogen-purged dry box. Toluene solutions of the precipitated asphaltenes were prepared by dissolving 30 grams of the asphaltenes in 300 ml of toluene under nitrogen and stirring for two hours. 120 grams of each catalyst was added to each solution of 30 grams of asphaltenes in the 300 ml of toluene and the mixture or slurry stirred for two hours at ambient temperature under a blanket of nitrogen. The toluene was removed from the slurry on a rotary evaporator and the residue dried in vacuo at 80° C. for 16 hours. The dried material was then placed in a dry box and ground to a particle size that would pass through a 20 mesh screen. This ground material was then charged to a Soxhlet thimble and extracted with tetrahydrofuran until the siphoned liquid was nearly colorless. The tetrahydrofuran, which contained the dissolved non-basic fraction, was removed from the collection flask. Pyridine was then added to the collection flask and the extraction carried out again until the siphoned liquid was nearly colorless. The pyridine fraction contained the dissolved basic fraction which was then also removed from the collection flask. The separated basic and non-basic fractions contained in the pyridine and tetrahydrofuran solutions, respectively, were isolated by evaporating the solvent and drying in vacuum at 80° C.

The results of this experiment are also shown in Table 1 and illustrate the fact that the solid acid catalysts selectively adsorb the basic asphaltenes from the mixture of basic and non-basic asphaltenes.

In order to further substantiate the fact that the solid acid catalyst selectively adsorbed the basic asphaltenes, a portion of both the basic and non-basic asphaltene fractions obtained by contacting the asphaltene-containing toluene solution with the DA-1 catalyst using the technique described above was redissolved in toluene and fractionated again using HCl according to the Sternberg technique. The results showed that the non-basic fraction obtained by the DA-1 separation was mostly non-basic according to the HCl test. Correspondingly, the basic asphaltene fraction was found to be mostly basic according to the HCl test.

EXAMPLE 2

In this experiment, samples of basic and non-basic asphaltene fractions obtained from coal liquids and separated by selective adsorption on the DA-1 catalyst using the technique set forth in Example 1 were analyzed by mass spectroscopy. The results indicated that the basic fraction had basic functional groups and that the non-basic fractions had acidic or neutral functional groups. Further, the mass spectroscopy studies indicated that the DA-1 catalyst did a better job of separating the basic and non-basic fractions than could be obtained using the HCl precipitation technique according to Sternberg.

EXAMPLE 3

This experiment serves to demonstrate that it is the acidity of the solid acid or solid acid catlayst which causes the selective adsorption and separation of the basic asphaltenes from the non-basic asphaltenes. This experiment was done in a manner similar to that in Example 1 except that the solid adsorbents used were the DA-1 and a neutral silica gel and the non-basic and basic asphaltenes were removed from the catalyst sequentially using the THF and pyridine using column chromatography at room temperature instead of the Soxhlet extraction. The results are presented in Table 2 and show that the acidic DA-1 gives a high yield of basic asphaltenes. In contrast, the neutral silica did not adsorb any basic asphaltenes at all.

EXAMPLE 4

This example serves to demonstrate that the solid acid can be heavily loaded with asphaltenes and still selectively adsorb basic asphaltenes from the basic/non-basic asphaltene mixture. This experiment was accomplished using a procedure similar to that in Example 1 wherein asphaltenes were dissolved in toluene which was then slurried with the catalyst followed by drying and crushing. The non-basic and basic asphaltenes were then removed from the catalyst using the column chromatography method in Example 3. The results are given in Table 3 and demonstrate that up to about 20 wt. % of total asphaltenes can be adsorbed on the solid acid without incurring any major change in the basic/non-basic cut point.

EXAMPLE 5

In this experiment, an elemental analysis was made of the basic and non-basic asphaltene fractions obtained by selectively adsorbing the basic fraction on the DA-1 catalyst using the procedure in Example 1. The asphaltenes used in this experiment were derived both from a Canadian Cold Lake crude and from the liquefaction product of Wyodak coal. The results of the analysis are shown in Table 4 and disclose that, with the possible exception of nitrogen content, there is essentially no difference for the Cold Lake samples in elemental analysis between the basic and non-basic fractions of each sample. However, both high resolution mass spectroscopy and electrochemical titration have shown that the nitrogen in the basic fraction is basic, while that in the non-basic fraction is non-basic. In the coal derived fractions, the nitrogen and oxygen actually fractionate. However, in this case, the acid phenolic oxygen and the non-basic nitrogen appear in the non-basic fraction, while the ether oxygen and basic nitrogen appear in the basic fraction. Thus, this establishes that elemental analysis alone does not give an indication of basicity.

EXAMPLE 6

This experiment demonstrates the sensitivity of the solid acid to moisture on the catalyst in the selective separation process of this invention. Samples of asphalt precipitated from both a Canadian Cold Lake crude and a Canadian Cold Lake 1050° F.+ vacuum resid were dissolved in toluene and slurried with samples of the DA-1 catalyst as-received from the manufacturer, and after being calcined at 500° C. Uncalcined catalysts generally contain from about 3–9 wt. % water, with 4–6% representing an average value. The asphalt-containing catalysts were then sequentially extracted with THF and pyridine using the procedure outlined in Example 1. The results of this experiment are shown in Table 5 and, as can be seen from the data, the yield of basic material using calcined DA-1 was substantially greater. This demonstrates that calcining the catalyst increased the adsorbtive capacity of the catalyst for the basic fraction.

TABLE 1

COMPARISON OF METHODS FOR SEPARATING BASIC ASPHALTENES

| Source of Asphaltenes | HCl Precip. wt. % | Solid Acid Adsorption wt. % DA-1 | Hi-Al |
|---|---|---|---|
| Tia Juana | 37.0 | 32.1 | 31.6 |
| Cold Lake | 25 | 32.8 | |

TABLE 2

THE EFFECT OF ADSORBENT ON BASIC ASPHALTENE SEPARATION*

| Source of Asphaltenes | Basic Asphaltene Yield, Wt. % DA-1 | SiGel |
|---|---|---|
| Tia Juana | 32.1 | 0 |
| Arab Heavy | 20.2 | — |

*NOTE:
10 wt. % initial loading of asphaltenes on the solid.

TABLE 3

THE EFFECT OF SOLIDS LOADING ON SEPARATION OF BASIC ASPHALTENES WITH DA-1

| | Loading, Wt. % Asphaltenes* on DA-1 | | |
|---|---|---|---|
| | 10 | 15 | 20 |
| Basic Asphaltene Yield, wt. % of Feed | 32.1 | 31.9 | 27.0–29.4 |

NOTE:
Asphaltenes from Tia Juana Medium crude oil.

TABLE 4

ELEMENTAL ANALYSIS OF COLD LAKE AND WYODAK ASPHALTENE FRACTIONS

| | COLD LAKE | | WYODAK | |
|---|---|---|---|---|
| | NON-BASIC | BASIC | NON-BASIC | BASIC |
| % C | 80.72 | 80.60 | 87.72 | 84.10 |
| % H | 7.79 | 7.59 | 6.41 | 6.31 |
| % N | 1.11 | 1.45 | 0.60 | 3.19 |
| % S | 7.76 | 7.65 | 0.60 | 0.60 |
| % O | 2.51 | 2.60 | 3.93 | 5.51 |
| V (PPM) | 813 | 770 | — | — |
| Ni (PPM) | 322 | 350 | — | — |

TABLE 5

Yields of Basic and Non-basic Cold Lake Asphaltenes from Calcined and As-received DA-1 Catalyst, wt. %

| Asphaltene Source | Catalyst | Non-Basic | Basic |
|---|---|---|---|
| Cold Lake Crude | Calcined | 62.4 | 37.6 |
| Cold Lake Crude | As-Received | 90.9 | 9.1 |
| Cold Lake Resid | Calcined | 62.1 | 37.9 |
| Cold Lake Resid | As-Received | 89.8 | 10.2 |

EXAMPLE 7

A 10 wt. % $WO_3$ on $\gamma$-$Al_2O_3$ (reforming grade of alumina obtained from Engelhard Industries, Inc. with a BET surface area of 220 $m^2/g$) catalyst was prepared using an aqueous solution of ammonium meta-tungstate sufficient to fill the pore volume of the alumina. The catalyst was dried in vacuo at 120° C. for 16 hours and then calcined in flowing air at 500° C. for 16 hours. This catalyst was used to separate the basic and non-basic asphaltenes which were recovered using the procedure described in Example 1, except that tetrahydropyran (THP) was used in place of tetrahydrofuran. The basic/non-basic asphaltene split obtained using this catalyst was 15/85. Following the removal of the non-basic and basic asphaltenes, the recovered catalyst was steamed for 16 hours at 900° C. in a tube furnace in an 80/20 helium/oxygen mixture sparged through water. The steamed catalyst was then calcined at 500° C. and a second asphaltene separation carried out.

In the second separation, the percentages of non-basic and basic asphaltenes were 82% and 18%, respectively. The non-basic fraction was recovered via Soxhlet extraction with THP and the amount of basic asphaltenes remaining on the catalyst was determined by the difference between the total amount of asphaltenes on the catalyst (20 wt.%) and the amount of recovered non-basic asphaltenes. The basic asphaltenes were then catalytically cracked off the catalyst at 550° C. to produce liquids, gas and a coked catalyst. The cracking was done by placing the basic asphaltene-laden catalyst in a quartz tube which was then inserted in a rapid pyrolysis unit which comprised a hot iron block. The coked catalyst was then regenerated using the 16 hour, 900° C. steaming treatment, calcined at 500° C. and used for a third separation, after which the catalyst was subjected to the Soxhlet extraction, asphaltene-cracking, steam regeneration and calcining steps used for the second separation. The calcined catalyst was then used for a fourth separation.

The third and fourth separations produced non-basic/basic yields of 67%/33% and 78%/22%, respectively. It should be noted that the Soxhlet extraction for the third separation was not done for as long a time as that for the first, second and fourth separations. This may explain the apparently greater yield of basic asphaltenes for the third separation.

This example serves to demonstrate the process of this invention and also shows that the basic asphaltene separation capacity of tungsten oxide on $\gamma$-$Al_2O_3$ is not reduced by a high temperature steaming treatment.

EXAMPLE 8

In this experiment a sample of the DA-1 silica-alumina catalyst described in Example 1 was steamed in a tube furnace for 16 hours at 900° C. 80/20 in $He/O_2$ sparged through water. This steaming treatment was designed to simulate steam gasification reaction conditions that would be used to remove coke from a catalyst. Following the steam treatment, the sample was calcined at 500° C. and then used to separate basic and non-basic asphaltenes from Cold Lake crude using the procedure described in Example 1. The basic/non-basic asphaltene split obtained using the steamed and calcined catalyst was 9/91 compared to 32/68 for a calcined sample of DA-1 that had not been steamed. This very low basic asphaltene adsorption capacity for a steamed silica-alumina catalyst compared to the unsteamed catalyst (Example 1) is due to the loss of acid centers for a high temperature steamed silica-alumina material. A steaming treatment similar to that described above, but with steaming temperature of 870° C., resulted in a reduction of $Ho \leqq 8.2$-type acid centers to 75 micromoles per gram ($\mu m/g$) [H. A. Benesi, J. Amer. Chem. Soc. 89, 5490 (1956)] compared to 425 $\mu m/g$ for an unsteamed sample.

This example serves to demonstrate the pronounced, irreversible reduction in strong acid centers with concomitant reduction in basic asphaltene adsorption capacity resulting from a high temperature steaming treatment of a conventional silica-alumina catalyst.

EXAMPLE 9

A TMO catalyst consisting of 12 wt. % $Ta_2O_5$ on $\gamma$-$Al_2O_3$ was prepared by impregnation with a solution of tantalum ethoxide in heptane sufficient to fill the pores of the alumina. The heptane was removed in vacuo and the alkoxide decomposed by calcination at 500° C. To this was added 9 wt. % $WO_3$ using the procedure described in Example 7.

This mixed oxide catalyst was employed for the separation of basic and non-basic asphaltenes as described in Example 1, except that tetrahydropyran was used in place of tetrahydrofuran. The non-basic/basic asphaltene split using this catalyst was 80/20.

After removing the adsorbed asphaltenes, the catalyst was steamed at 900° C. as described in Example 7, calcined at 500° C. and another asphaltene separation was carried out. In the second separation the non-basic/-basic asphaltene split was 79/21. Thus, steaming the catalyst did not effect its ability to adsorb basic asphaltenes.

EXAMPLE 10

In this experiment 20 wt.% of Cold Lake asphaltenes were deposited on the catalysts shown in Table 6 by adding same to a toluene solution of the asphaltenes, followed by removing the solvent in a rotary evaporator and then drying in vacuo at 80° C. The activity and selectivity of each catalyst for cracking off the asphaltenes and concomitant conversion of asphaltenes to liquid product was determined using the rapid pyrolysis technique described in Example 7. The results are shown in Table 6.

This example serves to demonstrate that the steamed catalysts of the instant invention have cracking activity comparable to an unsteamed silica-alumina catalyst. Silica-alumina is well known to those skilled in the art to be a very strong solid acid catalyst, but one that readily loses its acidity upon exposure to high temperature steam environments.

TABLE 6

| Example No. | Catalyst | Catalyst Pretreatment | % Liquids | % Coke |
|---|---|---|---|---|
| — | None | — | 27 | 61 |
| 7 | 10% $WO_3$ on $\gamma$-$Al_2O_3$ | Calcined at 500° C. | 30 | 60 |
| 7 | 10% $WO_3$ on $\gamma$-$Al_2O_3$ | $He/O_2$-Steamed at 900° C. then calcined at 500° C. | 32 | 58 |
| 8 | Silica-Alumina | Calcined at 500° C. | 32 | 58 |

What is claimed is:

1. A process for selectively removing basic asphaltenes from a basic asphaltene-containing hydrocarbon feed which comprises contacting said feed, in an adsorption zone and at a temperature below about 575° F., with a fresh or regenerated solid acid catalyst comprising at least one catalytic metal oxide selected from the group consisting essentially of the oxides of (a) tungsten, niobium and mixtures thereof and (b) mixtures of (a) with tantalum, hafnium, chromium, titanium, zirconium and mixtures thereof supported on an inorganic refractory metal oxide support, for a time sufficient to adsorb at least a portion of said basic asphaltenes from said feed to produce a feed of reduced basic asphaltene content wherein said catalyst has been calcined to remove adsorbed water from the surface thereof prior to being contacted with said feed.

2. The process of claim 1 wherein the basic asphaltene-laden catalyst is separated from the feed, the basic asphaltenes are cracked off the catalyst and the catalyst is regenerated.

3. The process of claim 2 wherein at least a portion of the asphaltene crackates are liquid hydrocarbons.

4. The process of claim 3 wherein said catalyst support comprises alumina.

5. The process of claim 4 wherein said alumina support comprises gamma-alumina.

6. The process of claim 4 wherein said support comprises a mixture of silica and alumina, and wherein the silica content thereof is less than about 50% of the alumina content thereof.

7. The process of either of claims 5 or 6 wherein the asphaltenes are cracked off the catalyst in the presence of steam.

8. The process of claim 7 wherein said catalyst is steamed at a temperature of at least 600° C. prior to being contacted with said feed.

9. The process of claim 8 wherein said catalyst is promoted with a promoter material comprising at least one Group IIA metal oxide.

10. The process of claim 9 wherein said promoter material is selected from the group consisting essentially of oxides of barium, calcium, strontium and mixtures thereof.

11. The process of claim 10 wherein said feed contains water in an amount less than the basic asphaltene content thereof.

12. A process for selectively removing basic asphaltenes from a basic asphaltene-containing hydrocarbon feed which comprises contacting said feed, in an adsorption zone at a temperature below about 575° F., with a fresh or regenerated solid acid catalyst comprising at least one catalytic metal oxide selected from the group consisting essentially of the oxides of (a) tungsten, niobium and mixtures thereof and (b) mixtures of (a) with tantalum, hafnium, chromium, titanium, zirconium and mixtures thereof supported on an alumina support having a surface area of at least about 40 $m^2/g$, for a time sufficient to adsorb at least a portion of said basic asphaltenes from said feed to produce a feed of reduced basic asphaltene content wherein said catalyst has been calcined to removed adsorbed water from the surface thereof prior to being contacted with said feed.

13. The process of claim 12 wherein the basic asphalteneladen catalyst is separated from the feed, the basic asphaltenes are cracked off the catalyst and the catalyst is regenerated.

14. The process of claim 13 wherein at least a portion of the asphaltene crackates are liquid hydrocarbons.

15. The process of either of claims 12, 13, or 14 wherein the asphaltenes are cracked off the catalyst in the presence of steam.

16. The process of claim 15 wherein said catalyst is steamed at a temperature of at least 600° C. prior to being contacted with said feed.

17. The process of claim 16 wherein said catalyst is promoted with a promoter material comprising at least one Group IIA metal oxide.

18. The process of claim 17 wherein said promoter material is selected from the group consisting of oxides of barium, calcium, strontium and mixtures thereof.

19. The process of claim 18 wherein said feed contains water in an amount less than the basic asphaltene content thereof.

20. The process of claim 15 wherein said support comprises a mixture of silica and alumina, and wherein the silica content thereof is less than about 50% of the alumina content thereof.

21. The process of claim 20 wherein said catalyst is promoted with a promoter material comprising at least one Group IIA metal oxide.

22. The process of claim 21 wherein said promoter material is selected from the group consisting essentially of oxides of barium, calcium, strontium and mixtures thereof.

23. The process of claim 22 wherein said feed contains water in an amount less than the basic asphaltene content thereof.

* * * * *